United States Patent [19]

Harrison

[11] Patent Number: 4,723,872

[45] Date of Patent: Feb. 9, 1988

[54] TRAPEZOIDAL DIVIDER WALL FOR USE IN SHAFT CONSTRUCTION

[75] Inventor: Warren L. Harrison, Evansville, Ind.

[73] Assignee: Frontier-Kemper Constructors, Inc., Evansville, Ind.

[21] Appl. No.: 642,444

[22] Filed: Jun. 26, 1984

[51] Int. Cl.[4] ..... E21D 5/04

[52] U.S. Cl. ..... 405/133; 52/608; 405/151

[58] Field of Search ..... 405/132, 133, 150, 151, 405/152, 153; 52/320, 474, 608, 609

[56] References Cited

U.S. PATENT DOCUMENTS

| | | | |
|---|---|---|---|
| 412,946 | 10/1889 | Cantwell . | |
| 1,370,686 | 3/1921 | Dodson | 52/609 |
| 1,982,308 | 11/1934 | Kahn et al. | 405/151 |
| 2,304,196 | 12/1942 | Oakley . | |
| 2,306,468 | 12/1942 | Rinderknecht . | |
| 3,417,568 | 12/1968 | Henderson . | |
| 3,435,619 | 4/1969 | McGuire | 405/133 |
| 3,495,369 | 2/1970 | Laroche . | |

FOREIGN PATENT DOCUMENTS

| | | | |
|---|---|---|---|
| 129296 | 8/1950 | Sweden | 52/609 |

*Primary Examiner*—David H. Corbin
*Attorney, Agent, or Firm*—John B. Miller

[57] ABSTRACT

A curtain wall (12) used to divide the shaft in a shaft construction (10) is made of panels (26) in the shapes of parallelograms. Side edges (28 and 30) of the panels (26) are received in channels (18 and 20) in the peripheral wall (16) of the shaft construction. These side edges are parallel to each other, and the perpendicular projections of each side edge are substantially non-overlapping with the other side edge. The result is that the panels can be lowered lengthwise into place and then rotated into the proper orientation. The panels can therefore be lowered through smaller openings than rectangular panels can, and they do not have to be lowered by "chivvying," as rectangular panels do.

8 Claims, 8 Drawing Figures

TRAPEZOIDAL DIVIDER WALL FOR USE IN SHAFT CONSTRUCTION

BACKGROUND OF THE INVENTION

The present invention is directed to shaft construction and, in particular, to the construction of interior walls in mine shafts and other excavation.

In the construction of a mine shaft, peripheral walls generally define the shaft and provide support to hold out the surrounding earth. In addition to these peripheral walls, it is often desired to provide interior walls, a common type being a curtain wall, which extends longitudinally through the shaft to divide it into two or more parts, one or more parts serving to provide ventilation and the other parts serving as, for instance, an elevator shaft.

A common method of constructing such walls in the past has been to provide opposed, longitudinally extending channels in the peripheral walls. Reinforced-concrete panels with side edges received in the opposed channels are lowered one at a time through the shaft. The side edges of the panels have a natural tendency to bind in the channels because it is impossible as a practical matter to keep them perfectly parallel to the channels walls while they are being lowered, and slight rotation from a parallel orientation results in binding. In the case of a vertical shaft, therefore, the normal way to lower through the shaft is to alternately "work" it into place, i.e., to apply and release an upward force on the panel so that it pivots slightly. This brings the panel momentarily into an orientation in which its side edges are substantially parallel to the walls of the channel and the static friction between the panel and the channel walls is overcome by gravity. The panel accordingly drops a short distance and binds again. This operation is repeated so that the panel is lowered in a stepwise manner to its assigned location. The next panel follows in a similar manner until it rests with one of its edges abutting one of those of the previous panel.

This method of wall construction is advantageous because it allows the individual reinforced-concrete panels to be constructed outside of the shaft. However, the stepwise process of maneuvering the panel through the shaft is time-consuming. Furthermore, it makes scheduling the construction of different shaft-structure parts inflexible, because the panels cannot be lowered if there are any intermediate platforms in the shaft that extend into the space between the channels. These problems exist not only for vertical shafts but also for diagonal or horizontal ones.

It is accordingly an object of the present invention to construct interior shaft walls in a more-rapid manner and in a manner that permits more flexibility in construction scheduling than was possible in prior-art methods.

Further, it is an object of the invention to provide improved panel structures which facilitate the construction of interior shaft walls.

SUMMARY OF THE INVENTION

The foregoing and related objects of the present invention are achieved with a novel structural panel that spans opposed longitudinal channels in the shaft wall. The panel has a pair of parallel side edges that extend between transverse edges to define panel faces that are substantially in the form of trapezoids, preferably parallelograms, in which the perpendicular projections of each side edge are substantially non-overlapping with the other side edge. The term "trapezoid", as used herein, refers to those quadrilaterals with at least one pair of parallel sides. The term "parallelogram", as used herein refers to those quadrilaterals with two pairs of parallel sides. As used herein, the term parallelogram refers to a subset of those quadrilaterals that are trapezoids. This permits the contractor to feed the panels into a shaft with their transverse edges generally parallel to the longitudinal axis of the shaft. As they are moved to the desired location, they present a cross section of minimal area to lateral surfaces in the shaft, and thus readily pass through platform or lateral wall openings of limited size. When at the desired location, they are quickly rotated into position in the shaft channels.

As an example of the significant advantages of the present invention, I have found that a field test of the invention led to approximately a doubling of the installation rate of a precast divider wall. This shows that the panel and method described herein will produce substantial cost savings in the construction of long and large shafts. Further, elimination of the need to "chivvy" the panel into place reduces breakage, enables the use of substantially wider panels, and reduces installation danger.

When the panel reaches the desired location, it is pivoted into its final orientation. Not only is this method of construction faster than prior-art methods, but it affords greater flexibility, since it generally does not require the removal of intermediate platforms from the shaft.

BRIEF DESCRIPTION OF THE DRAWINGS

These and further features and advantages of the present invention are described in connection with the accompanying drawings, in which.

DETAILED DESCRIPTION OF THE PREFERRED EMBODIMENT

Figure 1A:
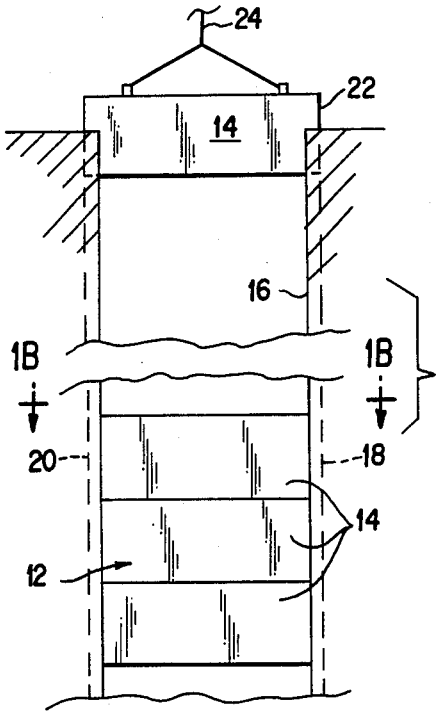
FIG.1A PRIOR ART
FIGS. 1A and 1B are vertical sectional and plan views, respectively, of a shaft construction employing a prior-art panel.
Figure 1B:
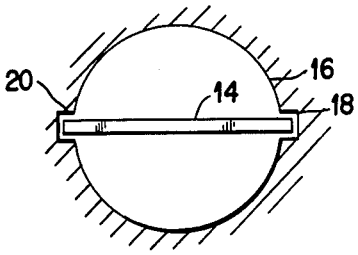
FIG. 1B PRIOR ART

FIGS. 1A and 1B depict a shaft construction 10 in which a curtain wall 12 is made of panels 14 of the type employed in the prior art. In this shaft construction, a peripheral wall 16 has opposed inward-opening channels 18 and 20 provided in it to receive side edge 22 of the panels 14.

A cable 24, supported by a crane or similar device (not shown), lowers the panels into position. It will be appreciated that the panels cannot be positioned by merely releasing the upward force on the cable and allowing the panels to slide into place. The side edges of the panel 22 that are received in the channels 18 and 20 will not stay perfectly parallel to the walls of those channels, so the panel will bend because of friction between the panel and channel walls. Thus, it is necessary to "chivvy" the panel into place by repeatedly applying momentary upward forces on it. This causes the panel temporarily to achieve the needed parallel orientation, in which the static friction is reduced to the point at which it is overcome by gravity and the panel slides a short distance downward. The panel then becomes lodged in the channel again and must again be subjected to the momentary upward force. This can be a time-consuming process.

This process has an additional difficulty. Frequently it is necessary to construct platforms at various levels of the shaft during shaft construction to allow work in the shaft walls. These platforms present an impediment to insertion of the panels. Thus, the platforms must be removed or, at the least, constructed to provide openings as wide as the curtain wall for the passage of panels therethrough. Further, some superstructure at the mouth of the shaft is typically employed during construction. This superstructure normally includes a so-called collar deck, whose presence prevents the panels from sliding into place in the orientation required by this prior-art method. Accordingly, the collar deck and superstructure must be removed before the method depicted in FIGS. 1A and 1B is employed.

Figure 2:
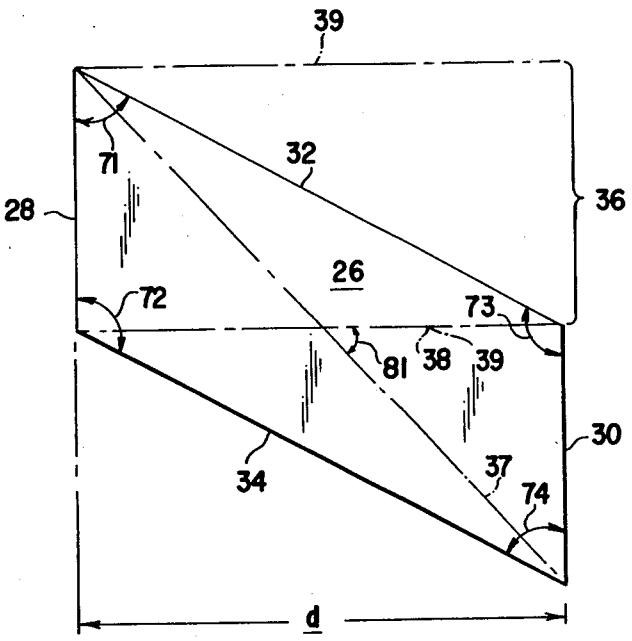
FIGS. 2 and 2A are diagrams illustrating the geometric properties of the preferred embodiment of the panel of the present invention where the panel is a parallelogram.

The method of the present invention also employs panels. The preferred faces of these panels are in the shapes of parallelograms, as FIG. 2 shows. In FIG. 2, a panel 26 has a pair of parallel side edges 28 and 30 between which a second pair of parallel transverse edges 32 and 34 extend.

As shown in FIG. 2, and as used in this application, lateral shaft axis 39 and distance d represent the perpendicular distance between side edges 28 and 30. The perpendicular distance is measured on a line constructed from either side edge which is perpendicular to each side edge. As shown in FIG. 2, the perpendicular projection 36 of side edge 28 is constructed by projecting two lines perpendicular to side edge 28 to the other side of the shaft. As used in this application, side edges 28', and 28'' are projected across the shaft to the other side in a similar manner, and referred to as "perpendicular projections" or "projections."The perpendicular distance between the side edges 28 and 30 (the length of lateral shaft axis 39) is approximately equal to the lateral distance d between the channels that will receive them. The angles 71, 72, 73, and 74 between the side edges and transverse edges are such that the perpendicular projection of each side edge, such as perpendicular projection 36 of side edge 28, has substantially no overlap with the other side edge, such as side edge 30. It is this characteristic that permits panel 26, unlike rectangular panels, to be lowered into place and then pivoted into the proper orientation.

This can be appreciated by considering the major and minor diagonal axes 37 and 38 of the panel 26. While a panel is in this intended position, with its side edges parallel to the peripheral shaft walls, and the perpendicular projections of each side edge does not overlap with the other side edge, the panel's major and minor diagonal axes are not angularly displaced in different directions from a lateral axis 39 (see also FIG. 3) of the shaft.

Figure 2A:
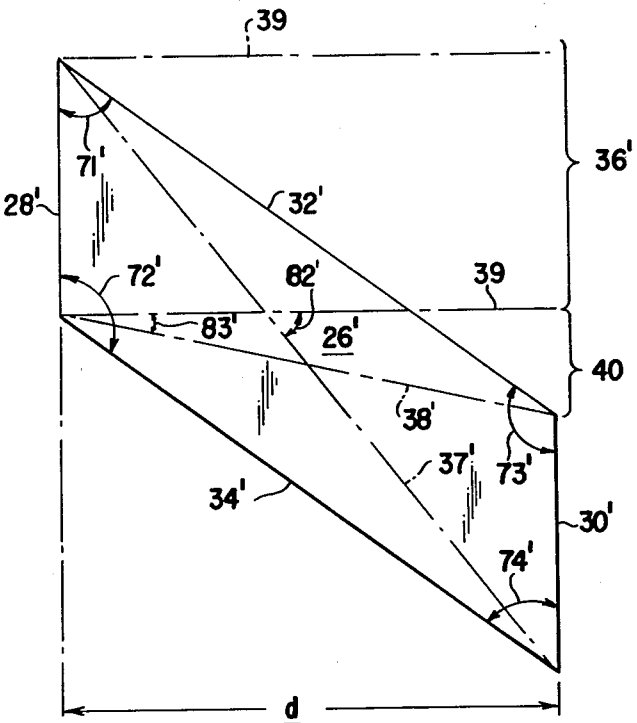

In the case illustrated in FIG. 2, in which the perpendicular projection 36 of side edge 28 just touches side edge 30 but does not overlay it, the minor axis 38 coincides with a lateral axis 39 and the major axis 37 forms an angle 81 with it. FIG. 2A depicts a panel 26' that is similar to panel 26 but has a clearance distance 40 between one side edge 30' and the perpendicular projection 36' of the other side edge 28'. In the panel of FIG. 2A, the major axis 37' and the minor axis 38' form angles 82 and 83 in the same direction with a lateral axis 39 of the shaft.

Figure 2B:
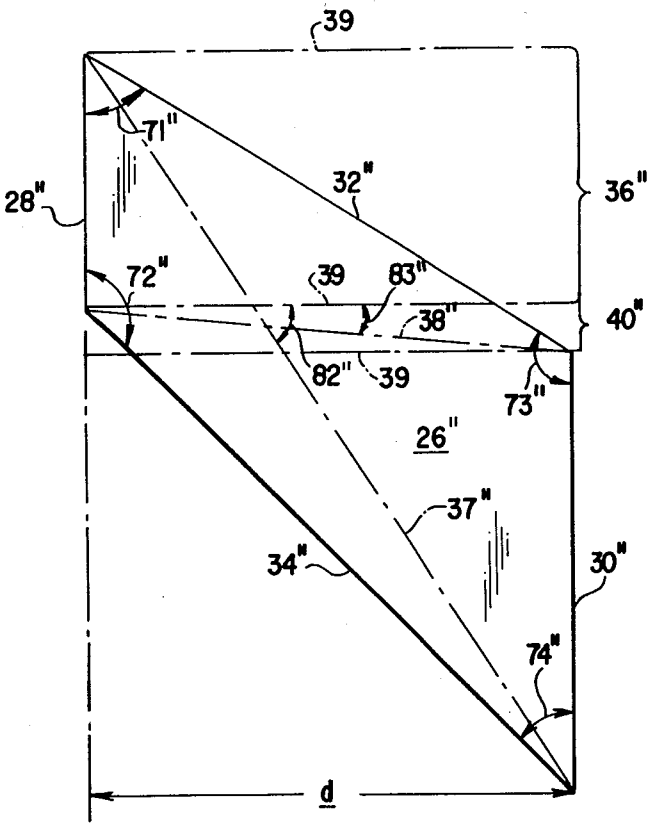
FIG. 2B is a diagram illustrating the geometric properties of the panel of the present invention where the panel is a trapezoid.

FIG. 2B shows a trapezoidal panel 26'' with one pair of parallel side edges 28'' and 30'' between which a pair of non-parallel transverse edges 32'' and 34'' extend. The perpendicular distance 39 between the side edges 28'' and 30'' is approximately equal to the lateral distance d between the channels that will receive them. The angles 71'', 72'', 73'', 74'' between the side edges and transverse edges are such that the perpendicular projection of each side edge, such as perpendicular projection 36'' of side edge 28'', has substantially no overlap with the other side edge, such as side edge 30''. This characteristic permits panel 26'' to be lowered into place and pivoted into the proper orientation. The major axis 37' and the minor axis 38'' form angles 82'' and 83'' in the same direction with a lateral axis 39 of the shaft.

In panels 26, 26', and 26'', the projections of the major and minor diagonal axes on a lateral shaft axis 39—e.g., in the illustrated embodiment, a diameter of the shaft—are approximately equal to the distance between the shaft channels: the panel spans the separation of the channels. And in each panel, a clockwise rotation increases the angles 81, 82', 83', 82'', 83'' that both the major and minor axes form with a lateral shaft axis 39, so the lengths of the projections of the axes onto the lateral shaft axis 39 decrease to lengths that are less than the distance d between the channels. The side edges 28, 28', 28'', 30, 30', 30'' thus move away from the peripheral shaft walls, and there is therefore no binding.

If the perpendicular projections of the side edges did overlap, as they do in rectangular panels, the diagonal axes would be angularly displaced in opposite directions from a lateral shaft axis 39. Therefore, rotation of the panel in either direction from the intended orientation would cause one or the other of the diagonal axes to decrease its angle with a lateral axis 39 and thus increase its projection on that axis to a length greater than the channel separation: the panel would bind in the channels. Thus, there should be no substantial overlap between the perpendicular projections of the panel side edges.

Figure 3:
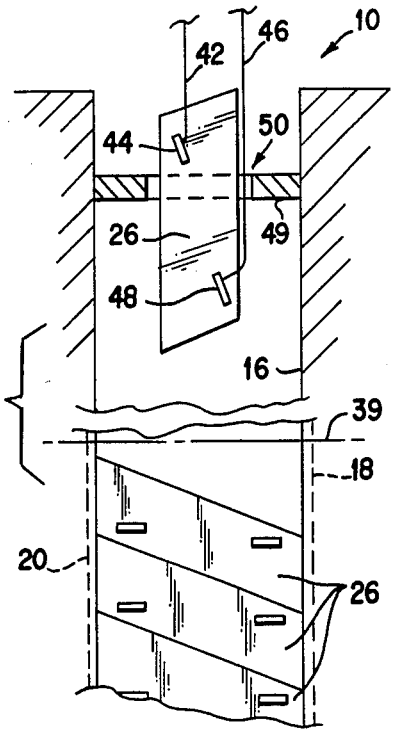
FIG. 3 is a vertical sectional view of an interior wall construction of a shaft in accordance with the present invention and showing a panel being lowered into position.
Figure 4:
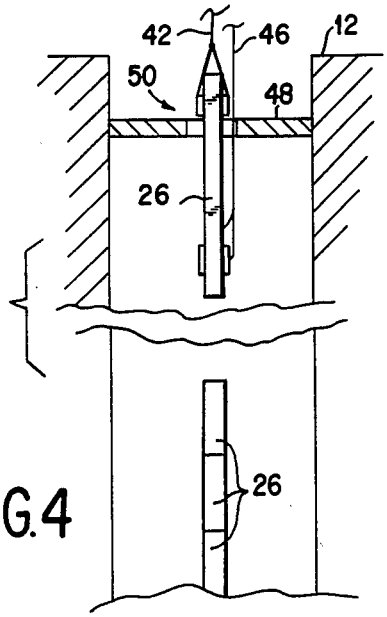
FIG. 4 is a vertical sectional view taken at an angle normal to that of FIG. 3.

Because of this ability of the panel to be rotated into the proper orientation without interference by the channel walls, a curtain wall can rapidly and efficiently be constructed with the panel of the present invention, as FIGS. 3 and 4 illustrate. In FIGS. 3 and 4, the peripheral wall 16 and channels 18 and 20 are the same as in FIGS. 1A and 1B. However, in place of the rectangular panels 14, parallelogram-shaped panels 26 make up the curtain wall, and FIGS. 3 and 4 show one such panel 26 being lowered into position by a cable 42 that hooks into the eye of an insert 44 provided in the curtain wall 26 for this purpose. A second cable 46 hooks onto another insert 48, but it is not used for lowering. Instead, it is used to rotate panel 40 when that panel reaches the intended position. It can readily be appreciated that panel 40, unlike panel 22, can simply be lowered into position without "chivvying".

FIGS. 3 and 4 also show a collar deck 49, which is a work platform on which a superstructure, not shown, might be mounted. In the prior-art method, it would be necessary to remove this collar deck 49 in order to lower the rectangular panel 22 into position; the rectangular panel 22 cannot be lowered lengthwise, because the walls of the channels 18 and 20 would interfere with its pivoting to the proper orientation. Since parallelogram-shaped panel 26 can be pivoted in this way, however, it can be oriented lengthwise to fit through a relatively small opening 50 in the collar deck 49. Thus, construction of the curtain wall of the present invention can be carried out without removal of collar decks and similar platforms.

Figure 5:
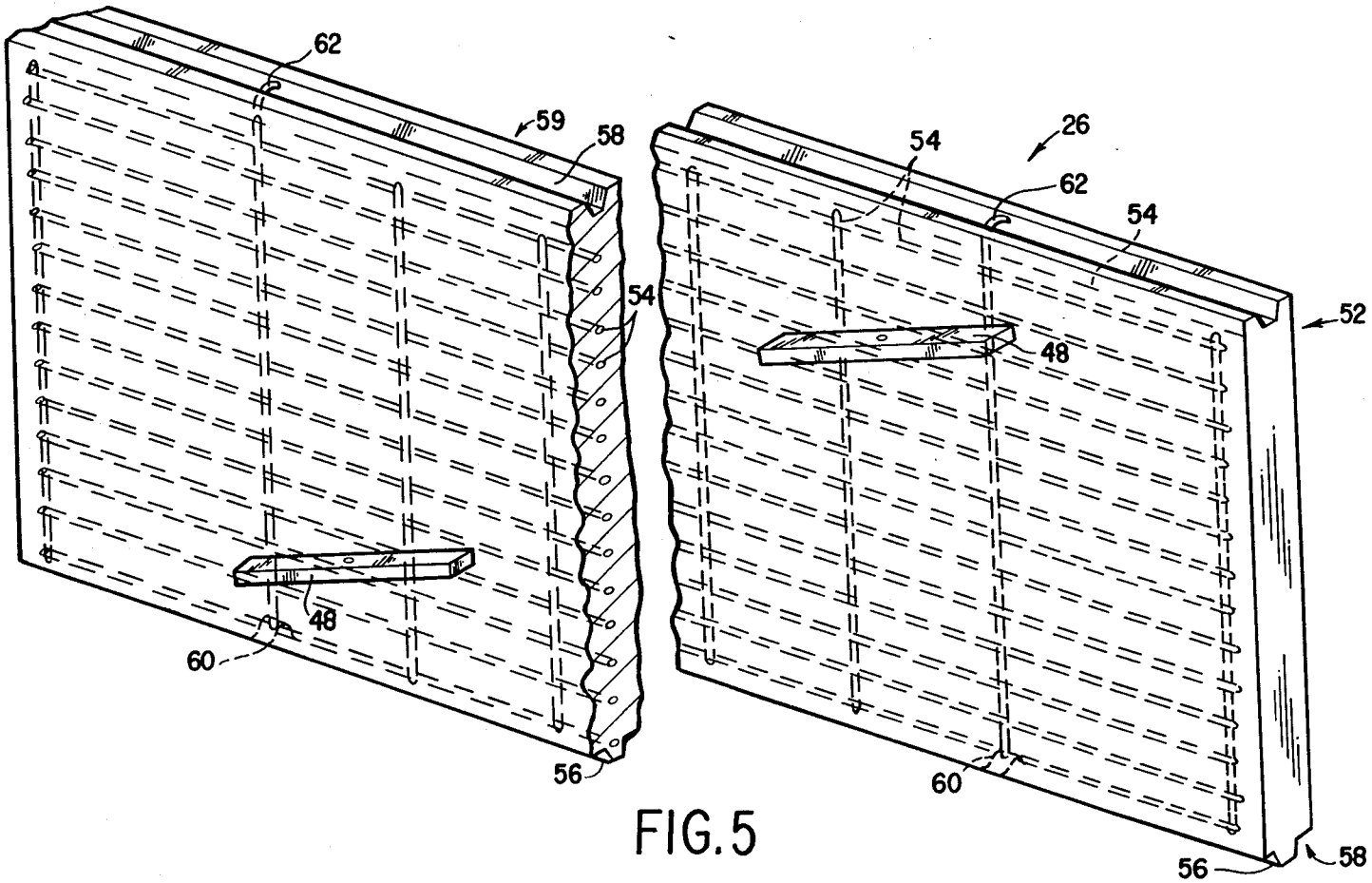
FIG. 5 is a perspective view, with parts broken way, of one embodiment of the panel of the present invention.

FIG. 5 shows a typical arrangement of the panel 26. The panel 26 is made of concrete 52 poured around reinforcing bars 54, which are provided in the normal manner except that horizontal bars are replaced with diagonal bars. The panel 26 is formed with a tongue 56 on the lower transverse edge 58 and a groove 58 in the upper transverse edge 59. When the panels are butted together as shown in FIG. 3, the grooves 58 snugly receive the tongues 56. Slots 60 are provided in tongues 56 to accommodate portions 62 of the reinforcing bars 54 that protrude from the channel 58 in the manner required by the conventional pre-stressing process.

Clearly, the method of the present invention affords much greater speed and flexibility than the prior-art method does. Furthermore, although I prefer to employ panels whose faces are parallelograms, other trapezoidal shapes can be employed so long as there is no substantial overlap of the perpendicular projections of the parallel side edges. In fact, the degenerate case of a trapezoidal face in which one of the parallel side edges has a negligible length—i.e., in which the panel faces are in the shape of a triangle—can be employed, e.g., as an end element at the top or bottom of the interior wall.

Thus, the teachings of the present invention can be followed in a wide variety of shaft-wall constructions.

I claim:

1. A method of constructing an interior wall in an elongated shaft defined by a peripheral wall structure having opposed, inward-opening channels separated by an interior-wall width, the method comprising the steps of:

A. providing a plurality of structural panels, each structural panel having substantially parallel first and second side edges, lying on first and second side edge lines, respectively, that are separated by a perpendicular distance, extending between transverse edges to define substantially trapezoidal faces, the first and second side edges meeting the transverse edges at corner points associated with the respective side edges, the line segment on the first side edge line defined by lines extending perpendicularly from the first side edge line to the corner points associated with the second side edge being called the perpendicular projection of the second side edge, the perpendicular distance between the side edges being approximately equal to the interior-wall width and the first side edge and the perpendicular projection of the second side edge being substantially non-overlapping;

B. orienting one of the panels in the shaft with its side edges disposed at such an angle to the peripheral wall that those edges are out of abutment with the peripheral wall, passing that panel longitudinally through the shaft to a predetermined location therein, and then pivoting that panel to place its side edges in the channels in abutment with the peripheral wall; and C. repeatedly adding further panels by orienting each further panel with its side edges disposed at an angle to said wall that those edges are out of abutment with the peripheral wall, passing that panel longitudinally along the shaft to the vicinity of the previous panel, and then pivoting that panel to place its side edges in the channels in abutment with the peripheral wall and one of its transverse edges in abutment with a transverse edge of the previous panel.

2. A method as defined in claim 1 wherein the transverse edges of each structural panel are also substantially parallel to each other so that the faces of each panel are in the forms of parallelograms.

3. A method as recited in claim 1 wherein the shaft is a substantially vertical shaft and the steps of passing the panels along the shaft include suspending each panel in the shaft and lowering the panel with its side edges disposed at such an angle to the peripheral wall that those edges are out of abutment with the peripheral wall.

4. A method as defined in claim 3 wherein:

A. the steps of lowering the panels include lowering each panel by means of a first cable attached to the panel at a first position thereon; and B. the steps of pivoting the panels include pivoting each panel by means of a second cable attached to the panel at second position thereon spaced from the first position.

5. A method as defined in claim 1 wherein the steps of passing the panels longitudinally along the shaft include passing them through a passage whose largest dimension is less than the interior-wall width.

6. A shaft construction comprising:

A. a peripheral wall structure defining an elongated shaft and providing opposed, inward-opening channels separated by an interior-wall width; and B. an interior wall extending longitudinally of the shaft and including a plurality of structural panels, each structural panel having substantially parallel first and second side edges, lying on first and second side edge lines, respectively, that are separated by a perpendicular distance, received in the channels and extending between transverse edges to define substantially trapezoidal faces, the first and second side edges meeting the transverse edges at corner points associated with the respective side edges, the line segment on the first side edge line defined by lines extending perpendicularly from the first side edge line to the corner points associated with the second side edge being called the perpendicular projection of the second side edge, the perpendicular distance between the side edges being approximately equal to the interior-wall width and the first side edge and the perpendicular projections of the second side edge being substantially non-overlapping to permit the side edges to be removed from the channels by rotation of the panel in a plain parallel to the faces.

7. A shaft construction as defined in claim 6 wherein the transverse edges of each structural panel are also substantially parallel to each other so that the faces of each panel are in the forms of parallelograms.

8. A shaft construction as defined in claim 6 wherein one of the transverse edges of each panel provides a tongue and the other mating edge provides a complementary groove that receives the tongue of an adjacent panel.

* * * * *